US008461914B2

(12) United States Patent
Shibayama

(10) Patent No.: US 8,461,914 B2
(45) Date of Patent: Jun. 11, 2013

(54) REFERENCE SIGNAL GENERATING CIRCUIT

(75) Inventor: Naoya Shibayama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 414 days.

(21) Appl. No.: 12/624,153

(22) Filed: Nov. 23, 2009

(65) Prior Publication Data

US 2010/0214013 A1 Aug. 26, 2010

(30) Foreign Application Priority Data

Feb. 24, 2009 (JP) ..... 2009-40913

(51) Int. Cl.
*G05F 1/10* (2006.01)

(52) U.S. Cl.
USPC ..... 327/543; 327/531

(58) Field of Classification Search
USPC ..... 327/538, 539, 541, 543; 323/313–315
See application file for complete search history.

(56) References Cited

U.S. PATENT DOCUMENTS 6,002,243 A * 12/1999 Marshall ..... 323/313
7,227,401 B2 * 6/2007 Zhang et al. ..... 327/539

FOREIGN PATENT DOCUMENTS

EP 0596653 A1 5/1994
JP 7-146725 6/1995
JP 2006-146906 A 6/2006

* cited by examiner

*Primary Examiner* — Long Nguyen
(74) *Attorney, Agent, or Firm* — Fujitsu Patent Center

(57) ABSTRACT

According to an aspect of the invention, a reference signal generating circuit includes a band gap reference main unit that includes a first cascode current mirror unit having a plurality of first conductive-type transistors; a second cascode current mirror unit having a plurality of second conductive-type transistors; a reference unit that uses a band gap to generate a reference signal; a first bias voltage generating unit that generates a bias voltage of the second cascode current mirror unit; a second bias voltage generating unit that generates a bias voltage of the first cascode current mirror unit; and an output unit that generates a reference signal based upon an output of the band gap reference main unit to generate and outputs the reference signal, wherein the second cascode current mirror unit is connected between the first cascode current mirror unit and the reference unit.

7 Claims, 13 Drawing Sheets

REFERENCE SIGNAL GENERATING CIRCUIT

CROSS-REFERENCE TO RELATED APPLICATION

This application is based upon and claims the benefit of priority of the prior Japanese Patent Application No. 2009-40913, filed on Feb. 24, 2009, the entire contents of which are incorporated herein by reference.

FIELD

The embodiments discussed herein are related to a reference signal generating circuit.

BACKGROUND

An analog circuit needs a voltage or a current as a reference of its operation. Therefore, generally, a reference signal generating circuit, such as a reference voltage generating circuit and a reference current generating circuit, is used. Particularly, an analog circuit that requires accuracy needs a reference signal generating circuit that is not dependent on fluctuations in power source or fluctuations in temperature.

For example, a reference current generating circuit is known as the reference signal generating circuit in which two current mirror circuits are connected in a loop shape and a current value is determined by one resistance.

[Patent Document 1] Japanese Laid-open Patent Publication No. 7-146725

With a decrease in power source voltage of a semiconductor device, a reference signal generating circuit that operates at a further low voltage is needed. In addition, when a reference signal generating circuit is packaged in a chip, it is necessary not to be dependent on fluctuations in power source or fluctuations in temperature as much as possible.

SUMMARY

According to an aspect of the invention, a reference signal generating circuit includes a band gap reference main unit that includes a first cascode current mirror unit having a plurality of first conductive-type transistors; a second cascode current mirror unit having a plurality of second conductive-type transistors; a reference unit that uses a band gap to generate a reference signal, wherein the first cascode current mirror unit is connected to a first potential, the reference unit is connected to a second potential, and the second cascode current mirror unit is connected between the first cascode current mirror unit and the reference unit; a first bias voltage generating unit that copies a current flowing through the first cascode current mirror unit to generate a bias voltage of the second cascode current mirror unit; a second bias voltage generating unit that copies a current flowing through the second cascode current mirror unit to generate a bias voltage of the first cascode current mirror unit; and an output unit that uses a signal obtained based on an output of the band gap reference main unit to generate and output a reference signal.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A reference signal generating circuit that operates at a low voltage is a band gap reference circuit that uses a band gap voltage of a pn junction diode or pnp transistor. The band gap reference circuit may be conceivably of a type that uses an amplifier illustrated in FIG. 13A or of a type that uses a current mirror illustrated in FIG. 13B.

As described above, it is necessary to use a reference signal generating circuit that operates at a further low voltage, that is not dependent on fluctuations in power source or fluctuations in temperature, and that is able to provide an external circuit with a constant reference voltage or current.

Note that in this specification, to provide an external circuit with a constant reference voltage or current and not to be dependent on fluctuations in power source and fluctuations in temperature is termed "high accuracy".

Figure 13A:
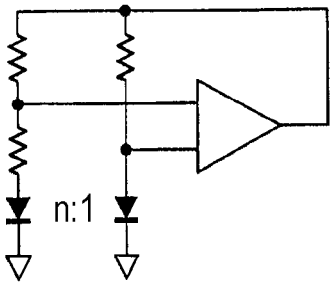
FIG. 13A to FIG. 13D illustrate examples of a reference signal generating circuit.

However, the band gap reference circuit that uses the amplifier illustrated in FIG. 13A includes a loop, which feeds back an output of the amplifier, inside the band gap reference circuit. Therefore, the operation of the loop is hard to keep stable, and oscillation may occur. In addition, in order to obtain low-voltage operation and high accuracy, it is only necessary to use an amplifier that is able to operate at a low voltage with a high gain; however, it is difficult to implement such an amplifier.

Figure 13B:
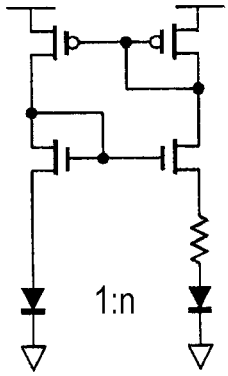

In addition, the band gap reference circuit that uses the current mirror illustrated in FIG. 13B has a simple circuit structure, and the operation also easily becomes stable. However, in order to obtain high accuracy, a cascode current mirror is used, so it is disadvantageous in low-voltage operation.

Figure 13C:
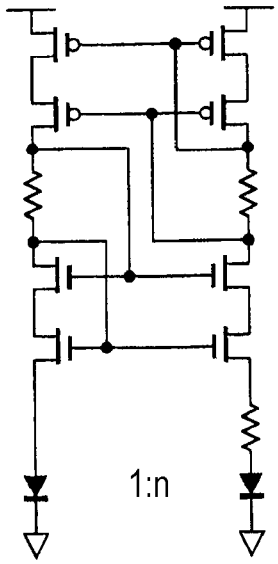
Figure 13D:
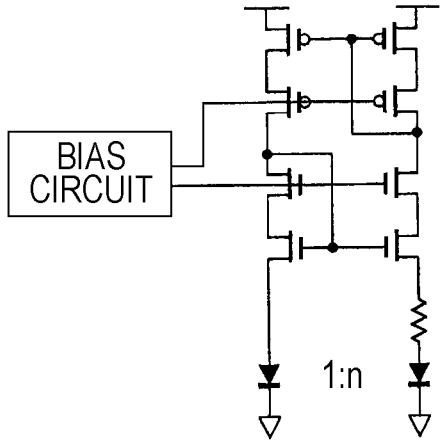

FIG. 13C and FIG. 13D illustrate band gap reference circuits, each of which uses a cascode current mirror and has been studied by the inventors.

The band gap reference circuit illustrated in FIG. 13C has resistance inside, so it is not appropriate for low-voltage operation. The band gap reference circuit illustrated in FIG.

13D is appropriate for low-voltage operation. However, it is necessary to have a bias circuit outside the band gap reference circuit and formed separately from the band gap reference circuit. Therefore, when the band gap reference circuit is packaged in a chip, a large area is needed. In addition, because a bias voltage is externally applied to the band gap reference circuit, it is difficult to guarantee that an optimal bias voltage is applied.

(First Embodiment)

Figure 1:
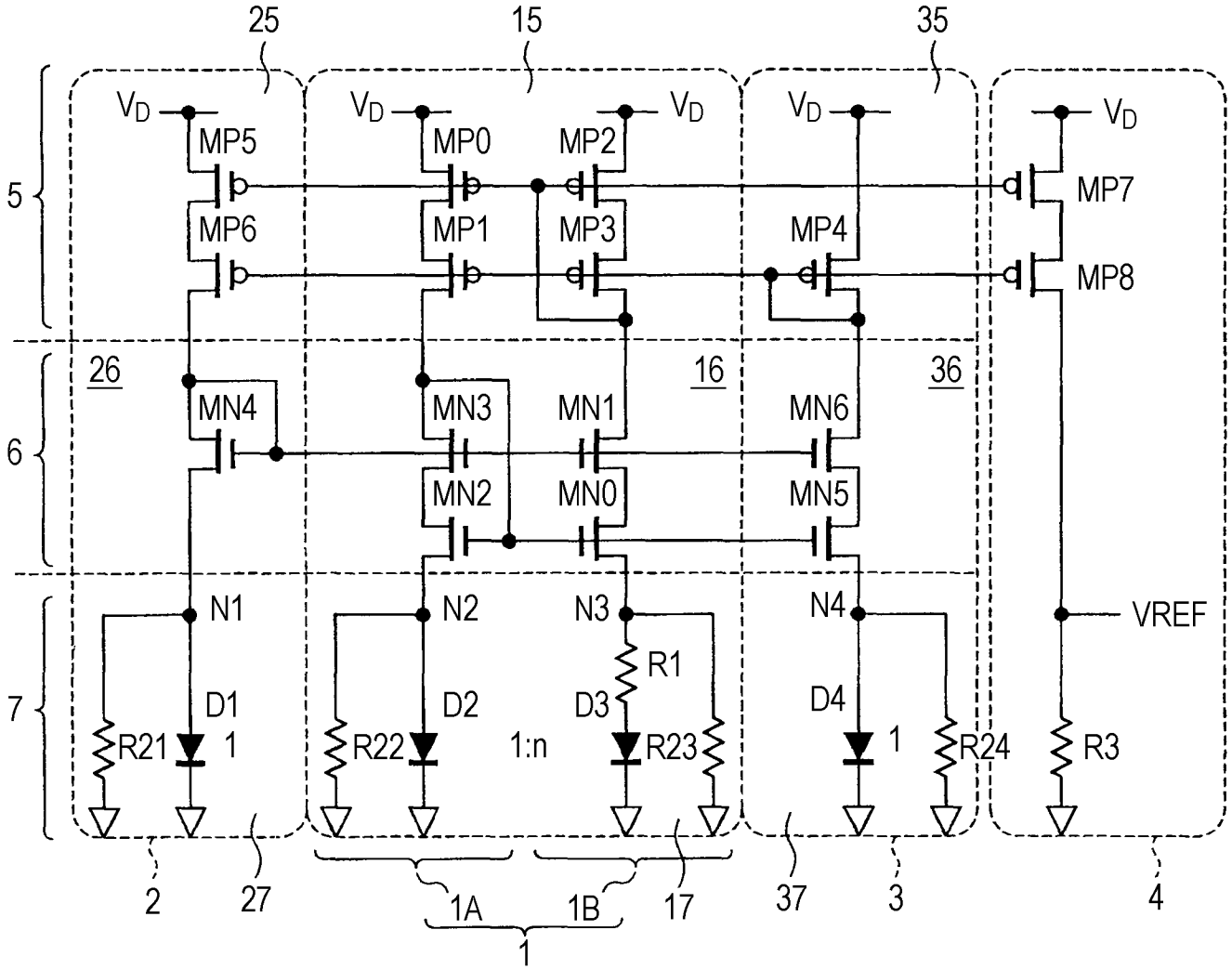
FIG. 1 illustrates an example of the configuration of a reference signal generating circuit.

FIG. 1 illustrates a configuration of a reference signal generating circuit according to a first embodiment.

The reference signal generating circuit illustrated in FIG. 1 includes a band gap reference main unit (hereinafter, referred to as "main unit") 1, a first bias voltage generating unit 2, a second bias voltage generating unit 3, and an output unit 4. The reference signal generating circuit illustrated in FIG. 1 is a reference voltage generating circuit that outputs a reference voltage VREF from the output unit 4.

Note that in FIG. 1, a p-channel MOSFET is indicated by a 0 mark on gate electrodes with a reference sign MP. In FIG. 1, an n-channel MOSFET is indicated without the O mark on gate electrodes with a reference sign MN. The same applies to the other drawings.

The main unit 1 includes a first cascode current mirror unit 15, a second cascode current mirror unit 16, and a reference unit 17. The first cascode current mirror unit 15 includes a plurality of first conductive-type transistors. The second cascode current mirror unit 16 includes a plurality of second conductive-type transistors.

In the reference voltage generating circuit illustrated in FIG. 1, the first conductive-type transistors are p-channel MOSFETs, and the second conductive-type transistors are n-channel MOSFETs.

In the main unit 1, the first cascode current mirror unit 15 includes p-channel MOSFETs (hereinafter, indicated by "MP") MP0 to MP3. In the first cascode current mirror unit 15, MP0 and MP1 are connected in series with each other, and MP2 and MP3 are connected in series with each other. A common signal is input to the gate electrode of MP0 and the gate electrode of MP2. In other words, a drain of MP3 is connected to the gate electrode of MP0 and the gate electrode of MP2. By so doing, a serial circuit formed of MP0 and MP1 and a serial circuit formed of MP2 and MP3 form a current mirror. In other words, for example, a current that flows through MP2 and MP3 is copied and also flows through MP0 and MP1.

In the main unit 1, the second cascode current mirror unit 16 includes n-channel MOSFETs (hereinafter, indicated by "MN") MN0 to MN3. In the second cascode current mirror unit 16, MN3 and MN2 are connected in series with each other, and MN1 and MN0 are connected in series with each other. A common signal is input to the gate electrode of MN3 and the gate electrode of MN1. That is, the drain of MN3 is connected to the gate electrode of MN3 and the gate electrode of MN1. By so doing, a serial circuit formed of MN3 and MN2 and a serial circuit formed of MN1 and MN0 form a current mirror. In other words, for example, a current that flows through MN3 and MN2 is copied and flows through MN1 and MN0.

In this way, the reference voltage generating circuit illustrated in FIG. 1 uses a current mirror in the band gap reference circuit that generates a reference signal, that is, in the main unit 1. By so doing, simplification of the structure of the reference signal generating circuit and the stable operation of the reference signal generating circuit is implemented. In addition to this, the reference voltage generating circuit illustrated in FIG. 1 further uses a cascode current mirror in the main unit 1. By so doing, high accuracy of the reference signal generating circuit is implemented.

Note that, as will be described later, the first bias voltage generating unit 2 and the second bias voltage generating unit 3 each include a circuit that corresponds to the first cascode current mirror unit 15 of the main unit 1. In other words, the first cascode current mirror unit 15 of the main unit 1 and circuits 25 and 35 that correspond to the first cascode current mirror unit 15 in the first bias voltage generating unit 2 and the second bias voltage generating unit 3 form a first cascode current mirror circuit 5.

In addition, as will be described later, the first bias voltage generating unit 2 and the second bias voltage generating unit 3 each includes a circuit that corresponds to the second cascode current mirror unit 16 of the main unit 1. In other words, the second cascode current mirror unit 16 of the main unit 1 and circuits 26 and 36 that correspond to the second cascode current mirror unit 16 in the first bias voltage generating unit 2 and the second bias voltage generating unit 3 form a second cascode current mirror circuit 6.

Furthermore, as will be described later, the first bias voltage generating unit 2 and the second bias voltage generating unit 3 each include a circuit that corresponds to part of the reference unit 17 of the main unit 1. Here, part of the reference unit 17 is a portion that makes up a basic circuit 1A in the reference unit 17, that is, a diode D2 and a resistance R22. In other words, the reference unit 17 of the main unit 1 and circuits 27 and 37 that correspond to the reference unit 17 in the first bias voltage generating unit 2 and the second bias voltage generating unit 3 form a reference circuit 7.

From above, in the reference voltage generating circuit illustrated in FIG. 1, it may be considered that the main unit 1 is integrally formed with the first bias voltage generating unit 2 and the second bias voltage generating unit 3.

The first cascode current mirror circuit 5 is connected to a first potential. The reference circuit 7 is connected to a second potential. In the reference voltage generating circuit illustrated in FIG. 1, the first potential is a power source potential VD, and is, for example, 1.5 V. In addition, in FIG. 1, the second potential is a ground potential, and is, for example, 0 V. The second cascode current mirror circuit 6 is connected between the first cascode current mirror circuit 5 and the reference circuit 7.

Thus, the first cascode current mirror circuit 5 is a top row current mirror circuit connected to the power source potential VD side (upper side in the drawing). The second cascode current mirror circuit 6 is a bottom row current mirror circuit connected to the ground potential side (lower side in the drawing).

In the main unit 1, the reference unit 17 includes a diode D2, a diode D3, a resistance R1, and two resistances R22 and R23. The diode D2 and the resistance R22 are connected between the source of MN2 of the second cascode current mirror unit 16 and the ground potential. A serial circuit, formed of the diode D3 and the resistance R1, and the resistance R23 each are connected between the source of MN0 of the second cascode current mirror unit 16 and the ground potential.

In other words, in the reference unit 17, the first diode D2 is connected to one of the current mirrors that makes up the second cascode current mirror unit 16, and the second diode D3 is connected to the other one of the current mirrors that makes up the second cascode current mirror unit 16. The second diode D3 has a pn junction area that is n times as large as the pn junction area of the first diode D2. In other words, the ratio of the pn junction area of the first diode D2 to the pn junction area of the second diode D3 is 1 to n. The value of n is usually an integer equal to 2 or more. The value of n is selected in consideration of an area occupied by the diodes, variations, and the like.

In addition, the reference unit 17 includes a first auxiliary resistance R22 and a second auxiliary resistance R23. The first auxiliary resistance R22 is connected in parallel with the first diode D2. The second auxiliary resistance R23 is connected in parallel with the second diode D3. The value of the first auxiliary resistance R22 is substantially equal to the value of the second auxiliary resistance R23. Note that, as will be described with reference to FIG. 3, an auxiliary resistance R21 in the first bias voltage generating unit 2 and an auxiliary resistance R24 in the second bias voltage generating unit 3 also have substantially the same resistance values as those of the auxiliary resistances R22 and R23.

In this way, the reference unit 17 of the main unit 1 uses the band gap of silicon that makes up a semiconductor substrate, on which the first and second conductive-type transistors are formed, to generate a reference signal. Thus, the reference unit 17 is a band gap reference circuit that uses the band gap to generate a reference signal.

Note that, as may be understood from above, the main unit 1 may be considered to include a basic circuit 1A and an n multiplication circuit 1B when focusing on the internal flow of current. The basic circuit 1A includes MP0, MP1, MN3, MN2, the diode D2, and the resistance R2. The n multiplication circuit 1B includes MP2, MP3, MN1, MN0, the resistance R1, the diode D3, and the resistance R2.

The first bias voltage generating unit 2 includes MP5, MP6, MN4, the diode D1, and the resistance R2. MP5 and MP6 form the circuit 25 that corresponds to the first cascode current mirror unit 15 of the main unit 1. MN4 forms the circuit 26 that corresponds to the second cascode current mirror unit 16 of the main unit 1. The parallel connected diode D1 and resistance R2 form the circuit 27 that corresponds to the reference unit 17 of the main unit 1. Thus, MP5 and MP6, MN4, and the diode D1 are connected in series in the stated order between the power source potential VD and the ground potential. Note that the diode D1 is a diode having similar characteristics to that of the diode D2.

In this way, the first bias voltage generating unit 2 includes the plurality of first conductive-type transistors, that is, MP5 and MP6, that are similarly cascode-connected as those of MP0 and MP1 in the first cascode current mirror unit 15 of the main unit 1. In addition, the first bias voltage generating unit 2 includes the diode D1 having the same pn junction area as that of the first diode D2. In addition, the first bias voltage generating unit 2 includes the auxiliary resistance R21 that is connected in parallel with the diode D1 having the same pn junction area as that of the first diode D2.

Figure 3:
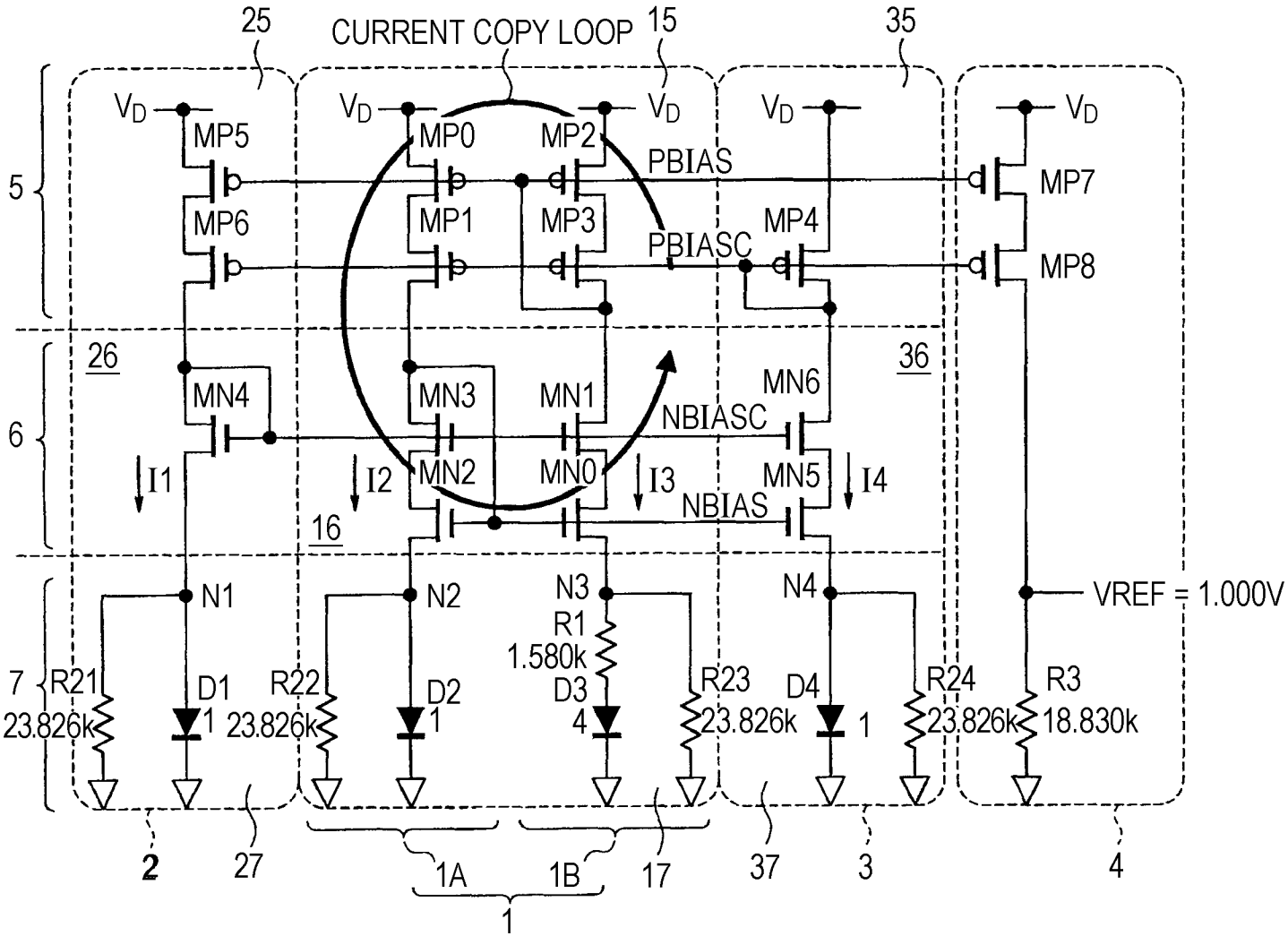
FIG. 3 is a view that illustrates the operation of the reference signal generating circuit.

Thus, the first bias voltage generating unit 2 copies a current that flows through the first cascode current mirror unit 15 of the main unit 1 by MP5 and MP6. The copied current flows through the diode-connected MN4. By so doing, the first bias voltage generating unit 2 generates a bias voltage NBIASC of the second cascode current mirror unit 16 of the main unit 1 by MN4. The bias voltage NBIASC is illustrated in FIG. 3. The bias voltage NBIASC is supplied to the second cascode current mirror unit 16 of the main unit 1. For example, the bias voltage NBIASC is supplied to the gate electrodes of MN3 and MN1. By so doing, the first bias voltage generating unit 2 is able to apply an optimal bias voltage to the second cascode current mirror unit 16.

Figure 4:
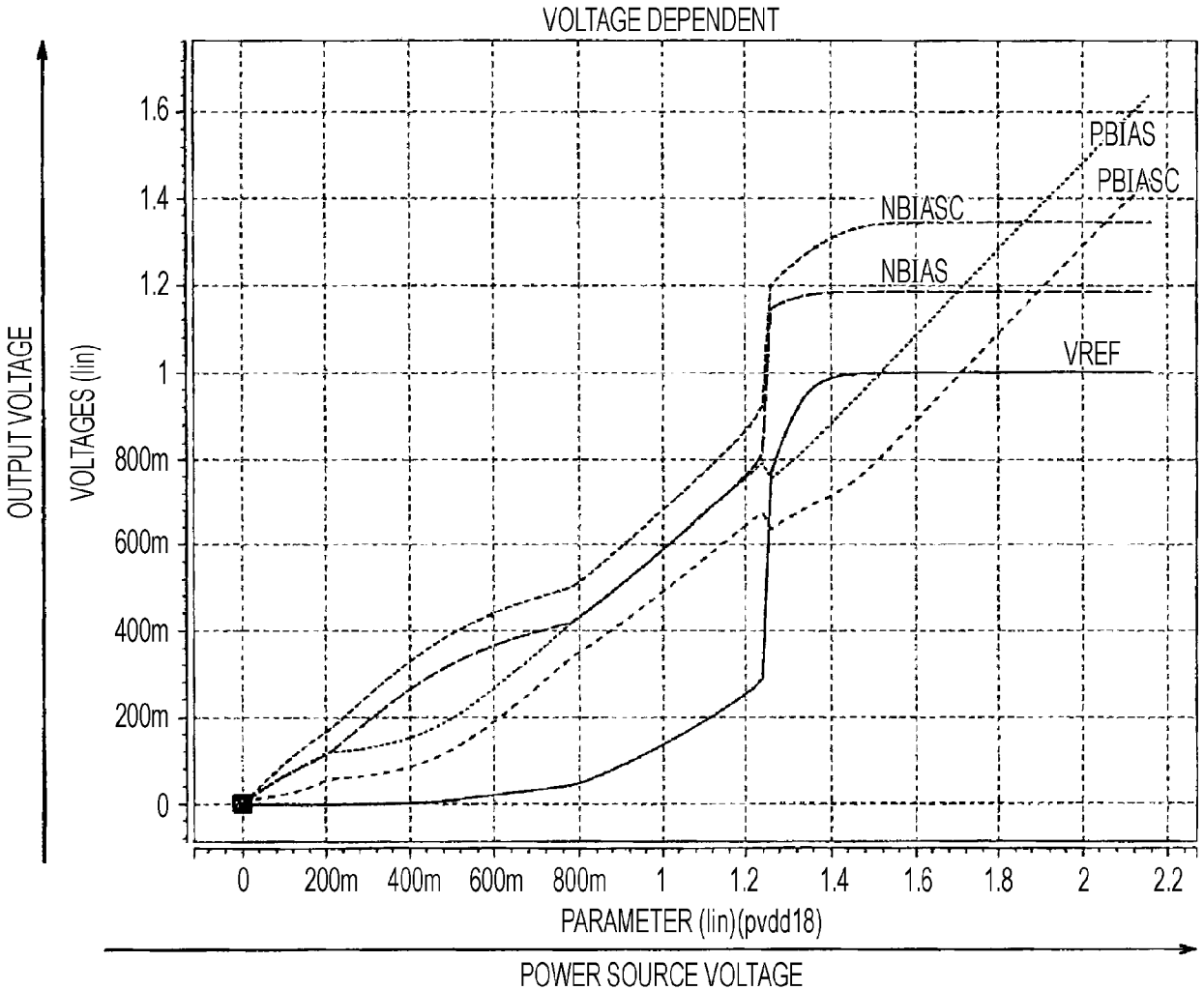
FIG. 4 illustrates the simulation result of the reference signal generating circuit.

As MN3 turns on by the bias voltage NBIASC, a current flows to the diode-connected MN2 via MN3. By so doing, in the first cascode current mirror unit 15, a voltage NBIAS is generated. The voltage NBIAS may be regarded as a secondary bias voltage generated based on the bias voltage NBIASC. The difference between the bias voltage NBIASC and the voltage NBIAS is illustrated in FIG. 4.

In the second cascode current mirror unit 16, the bias voltage NBIASC is supplied to the gate electrode of MN1, and the voltage NBIAS is supplied to the gate electrode of MN0. By so doing, as described above, the cascode current mirror is formed in the second cascode current mirror unit 16.

In the second bias voltage generating unit 3, the bias voltage NBIASC is supplied to the gate electrode of MN6, and the voltage NBIAS is supplied to the gate electrode of MN5. By so doing, the second bias voltage generating unit 3 is able to accurately copy the current that flows through the second cascode current mirror unit 16 of the main unit 1.

As described above, the configuration of the first bias voltage generating unit 2 is similar to the configuration of the basic circuit 1A of the main unit 1. For example, the configuration of MP5 and MP6 is similar to the configuration of MP0 and MP1 of the first cascode current mirror unit 15. The diode-connected MN4 corresponds to diode-connected MN2, and the configuration of the diode D1 and resistance R21 is similar to the configuration of the diode D2 and resistance R22 of the reference unit 17. Thus, the configuration of the first bias voltage generating unit 2 may be considered as a substantially similar configuration to the basic circuit 1A of the main unit 1. By so doing, it is possible to implement a reference voltage generating circuit that is able to operate at a low voltage and that is not dependent on fluctuations in power source or fluctuations in temperature.

The second bias voltage generating unit 3 includes MP4, MN6, MN5, the diode D4, and the resistance R2. MP4 forms the circuit 35 that corresponds to the first cascode current mirror unit 15 of the main unit 1. MN6 and MN5 form the circuit 36 that corresponds to the second cascode current mirror unit 16 of the main unit 1. The parallel connected diode D4 and resistance R24 form the circuit 37 that corresponds to the reference unit 17 of the main unit 1. Thus, MP4, MN6 and MN5 and the diode D4 are connected in series in the stated order between the power source potential VD and the ground potential. Note that the diode D4 is a diode having a similar characteristic to that of the diode D1 or D2.

In this way, the second bias voltage generating unit 3 includes the plurality of second conductive-type transistors, that is, MN6 and MN5, that are similarly cascode-connected as those of MN1 and MN0 in the second cascode current mirror unit 16 of the main unit 1. In addition, the second bias voltage generating unit 3 includes the diode D4 having the same pn junction area as that of the first diode D2. In addition, the second bias voltage generating unit 3 includes the auxiliary resistance R24 that is connected in parallel with the diode D4 having the same pn junction area as that of the first diode D2.

Thus, the second bias voltage generating unit 3 copies the current that flows through the second cascode current mirror unit 16 of the main unit 1 by MN6 and MN5. The copied current flows through the diode-connected MP4. By so doing, the second bias voltage generating unit 3 generates a bias voltage PBIASC of the first cascode current mirror unit 15 of the main unit 1 by MP4. The bias voltage PBIASC is illustrated in FIG. 3. The bias voltage PBIASC is supplied to the first cascode current mirror unit 15 of the main unit 1. For example, the bias voltage PBIASC is supplied to the gate electrodes of MP3 and MP1. By so doing, the second bias voltage generating unit 3 is able to apply an optimal bias voltage to the first cascode current mirror unit 15.

As MP3 turns on by the bias voltage PBIASC, a current flows to the diode-connected MP2 via MP3. By so doing, in the first cascode current mirror unit 15, a voltage PBIAS is generated. The voltage PBIAS may be regarded as a secondary bias voltage generated based on the bias voltage PBIASC. A difference between the bias voltage PBIASC and the voltage PBIAS is illustrated in FIG. 4.

In the first cascode current mirror unit 15, the bias voltage PBIASC is supplied to the gate electrode of MP1, and the voltage PBIAS is supplied to the gate electrode of MP0. By so doing, as described above, the cascode current mirror is formed in the first cascode current mirror unit 15.

In the first bias voltage generating unit 2, the bias voltage PBIASC is supplied to the gate electrode of MP6, and the voltage PBIAS is supplied to the gate electrode of MP5. By so doing, the first bias voltage generating unit 2 is able to accurately copy the current that flows through the first cascode current mirror unit 15 of the main unit 1.

As described above, the configuration of the second bias voltage generating unit 3 is similar to the configuration of the basic circuit 1B of the main unit 1. For example, the diode-connected MP4 corresponds to the diode-connected MP2, and the configuration of MN6 and MN5 is similar to the configuration of MN1 and MN0 of the second cascode current mirror unit 16. The configuration of the diode D4 and resistance R24 is similar to the configuration of the resistance R1, directly connected to the diode D3, and resistance R23 of the reference unit 17. Thus, the configuration of the second bias voltage generating unit 3 may be considered as a substantially similar configuration to the basic circuit 1B of the main unit 1. By so doing, it is possible to implement a reference voltage generating circuit that is able to operate at a low voltage and that is not dependent on fluctuations in power source or fluctuations in temperature.

The output unit 4 includes MP7, MP8, and a resistance R3. MP7 and MP8 are portions that correspond to the first cascode current mirror unit 15 of the main unit 1. The resistance R3 is a portion that corresponds to the reference unit 17 of the main unit 1. Thus, MP7, MP8, and the resistance R3 are connected in series in the stated order between the power source potential VD and the ground potential.

In this way, the output unit 4 includes the plurality of first conductive-type transistors, that is, MP7 and MP8, that are similarly cascode-connected as those of MP0 and MP1 in the first cascode current mirror unit 15. Thus, the output unit 4 copies the current that flows through the first cascode current mirror unit 15 by MP7 and MP8. Owing to the copied current and the resistance R3, the output unit 4 generates and outputs a reference voltage VREF.

In this way, the configuration of the output unit 4 is similar to the basic circuit 1A of the main unit 1. For example, the configuration of MP7 and MP8 is similar to the configuration of MP0 and MP1 of the first cascode current mirror unit 15. However, no portion that corresponds to the second cascode current mirror unit 16 of the main unit 1 is provided. A portion that corresponds to the reference unit 17 of the main unit 1 is the resistance R3. By so doing, the output unit 4 uses a signal obtained based on an output of the main unit 1 to generate and output a reference signal.

Figure 2:
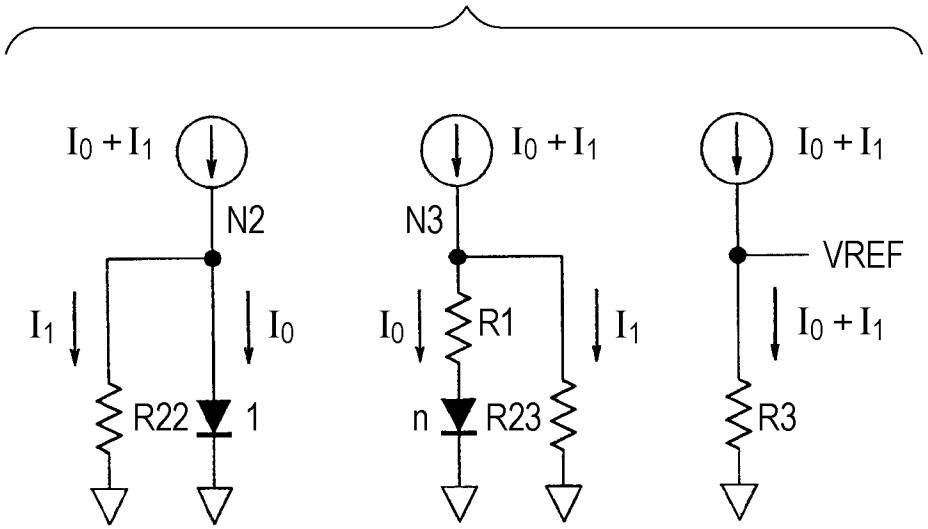
FIG. 2 is a view that partially illustrates the operation of the reference signal generating circuit.

Next, the operation of the reference voltage generating circuit illustrated in FIG. 1 will be simply described with reference to FIG. 2 and FIG. 3. FIG. 2 is a view that illustrates a case where a current source is assumed as a basic circuit of a band gap reference. FIG. 3 is a view that illustrates current values 11 to 14, a current copy loop, values of the resistances R1, R2, and R3 in the reference voltage generating circuit illustrated in FIG. 1.

In the reference signal generating circuit that uses a band gap reference, in FIG. 2, values of current (I0+I1) flowing from the current sources are substantially equal. In FIG. 2, a current source connected to a node N2 is designated using the basic circuit 1A of the main unit 1 as a current source. A current source connected to a node N3 is designated using the n multiplication circuit 1B of the main unit 1 as a current source. A current source connected to an output node that outputs the reference voltage VREF is designated using the output unit 4 as a current source.

As the condition that values of current (I0+I1) flowing from the current sources are substantially equal is applied to the reference voltage generating circuit illustrated in FIG. 3, the value of the current I2 is substantially equal to the value of the current I3. Then, the reference voltage generating circuit illustrated in FIG. 3 copies the currents I2 and 13 in a loop-like manner by the first cascode current mirror unit 15 and second cascode current mirror unit 16 of the main unit 1. At this time, the reference voltage generating circuit illustrated in FIG. 3 applies the bias voltages PBIASC and NBIASC having appropriate values to the first cascode current mirror unit 15 and second cascode current mirror unit 16 of the main unit 1. By so doing, it is possible to accurately copy the currents I2 and I3.

In the reference voltage generating circuit illustrated in FIG. 1, the configuration of the diode D1 and resistance R21 of the first bias voltage generating unit 2 is similar to the configuration of the diode D2 and resistance R22 in the basic circuit 1A of the main unit 1. By so doing, the current I1 substantially equal to the current I2 that flows through the main unit 1 flows in the first bias voltage generating unit 2. The configuration of the diode D4 and resistance R24 of the second bias voltage generating unit 3 is similar to the configuration of the diode D2 and resistance R22 in the basic circuit 1A of the main unit 1. By so doing, the current I1 substantially equal to the current I2 that flows through the main unit 1 flows in the second bias voltage generating unit 3. The currents I2 and I3 are currents that are mutually copied. Thus, I1=I2=I3=I4.

For example, currents that flow through MP2 and MP3 are copied to MP0 and MP1 by current mirror. Currents that flow through MP0 and MP1 flow through MN3 and MN2. Currents that flow through MN3 and MN2 are copied to MN1 and MN0 by current mirror. Currents that flow through MN1 and MN0 are substantially equal to currents that flow through MP2 and MP3.

On the other hand, currents that flow through MP2 and MP3 are copied to MP5 and MP6 by current mirror. This is substantially equal to the current that flows through MN4. By so doing, the second cascode current mirror circuit 6 is biased by a bias voltage that is generated based on a current that is substantially equal to the current that flows through the second cascode current mirror circuit 6. In addition, currents that flow through MN1 and MN0 are copied to MN6 and MN5 by current mirror. This is substantially equal to the current that flows through MP4. By so doing, the first cascode current mirror circuit 5 is biased by a bias voltage that is generated based on a current that is substantially equal to the current that flows through the first cascode current mirror circuit 5.

As a result, the source voltages of MN4 and MN5, that is, the voltages of the nodes N1 and N4 are substantially equal to the voltages of the nodes N2 and N3 of the main unit 1. By so doing, it is possible to generate appropriate bias voltages NBIASC and PBIASC in the diode-connected MN4 and MP4.

Furthermore, the output unit 4 applies the current, which is substantially equal to the current in the current copy loop, to the resistance R3 to thereby generate the reference voltage VREF. As a result, by selecting the value of the resistance R3, it is possible to generate a desired voltage as the reference voltage VREF.

Note that the current that flows through the resistance R3 may be a current that is adjusted at a ratio of current mirror. Here, the ratio of current mirror is a ratio of the size of MP0 and MP1 of the main unit 1 to the size of MP7 and MP8 of the output unit 4.

Next, the relationship among the value of the resistance R1, the values of the resistances R21 to R24, the ratio n of the diode, and the value of the resistance R3 of the output unit 4, used in the main unit 1, will be described in accordance with a reference voltage signal generating circuit that uses the band gap reference circuit illustrated in FIG. 1.

When the values of the current (I0+I1) flowing from the current sources are substantially equal, the reference voltage VREF may be expressed by the following mathematical expression.

$$V_{REF} = \frac{R_3}{R_2}\left(V_{BE} + \frac{R_2}{R_1}\frac{k_B T}{q}\ln n\right)$$

Where $k_B$: Boltzmann constant, q: quantity of electric charge of electron, T: absolute temperature Here, in each of the current sources illustrated in FIG. 2, when the value of the current I0 that flows toward each diode side is determined, the resistance value R1 is obtained from the following mathematical expression.

$$R_1 = \frac{k_B T}{q}\frac{\ln n}{I_0}$$

Next, the resistance value R2 selects a value by which temperature dependency of the diode may be cancelled, and is determined by the following mathematical expression.

$$R_2 = \frac{-\frac{\partial V_{BE}}{\partial T}}{\ln n\frac{\partial V_T}{\partial T}} R_1 = \frac{2.0\times10^{-3}}{\ln n\times0.08625\times10^{-3}} R_1 = \frac{23.188}{\ln n} R_1$$

Where $$\frac{\partial V_{BE}}{\partial T} = -2.0\,\text{mV}/°\text{C.},\quad \frac{\partial V_T}{\partial T} = \frac{k_B}{q} = \frac{1.38\times10^{-23}}{1.60\times10^{-19}} = 0.08625\text{mV}/°\text{C.}$$

Next, the value of the resistance R3 is determined by the ratio of the reference voltage VREF, which is a desired output, to the band gap voltage of silicon, obtained from an output of the band gap reference circuit. In other words, the reference voltage VREF, which is a desired output, may be determined from the value of the resistance R3 because the band gap voltage of silicon is determined.

$$R_3 = \frac{R_2 V_{REF}}{\left(V_{BE} + \frac{R_2}{R_1}\frac{k_B T}{q}\ln n\right)}$$

From this mathematical expression, for example, when a reference voltage source that outputs the reference voltage VREF=1 V is considered, the current I0 that flows through the diode is determined to be at 25 μA at a temperature of 27° C. (=300K). In this case, a forward voltage VBE of the diode is 670 mV. Note that, strictly, the value of the forward voltage VBE depends on a manufacturing process of a semiconductor device.

Here, assuming that the ratio n of the diode is determined to be "4" based on an area occupied by the reference signal generating circuit on the chip, the values of the resistances R1, R21 to R24, and R3 are as follows.

$$R_1 = \frac{k_B T}{q}\frac{\ln n}{I_0} = \frac{1.38\times10^{-23}\times300}{1.60\times10^{-19}}\frac{\ln 4}{25\times10^{-6}} = 1.435[k\Omega]$$

$$R_2 = xR_1 = \frac{23.118}{\ln 4}\cdot R_1 = 24.000[k\Omega]$$

$$R_3 = \frac{R_2 V_{REF}}{\left(V_{BE} + \frac{R_2}{R_1}\frac{k_B T}{q}\ln n\right)} = \frac{24.000\times10^3\times1.00}{0.67 + \frac{24.000\times10^3}{1.435\times10^3}\frac{1.38\times10^{-23}\times300}{1.60\times10^{-19}}\ln 4} = 18.898[k\Omega]$$

Note that the actual values of the resistances R1, R21 to R24, and R3 are influenced by a deviation of a diode characteristic from an ideal characteristic, temperature dependency of the resistance, or the like, so it is necessary to match the values through simulation.

FIG. 3 illustrates an example of the reference voltage generating circuit that outputs the reference voltage VREF=1.0 V and that is designed based upon the above calculation result.

As illustrated in FIG. 3, based upon the above calculation result, when the pn junction area of each of the diodes D1, D2, and D4 is 1, the pn junction area of the diode D3 is 4. The resistance R1 is set at 1.580 KΩ. The resistance R3 that determines the output voltage is set at 18.830 KΩ in order to obtain the reference voltage VREF=1.0 V. The auxiliary resistances R21 to R24 are set at 23.826 KSΩ in order to cancel the temperature dependency of each of the diodes D1 to D4.

Figure 5:
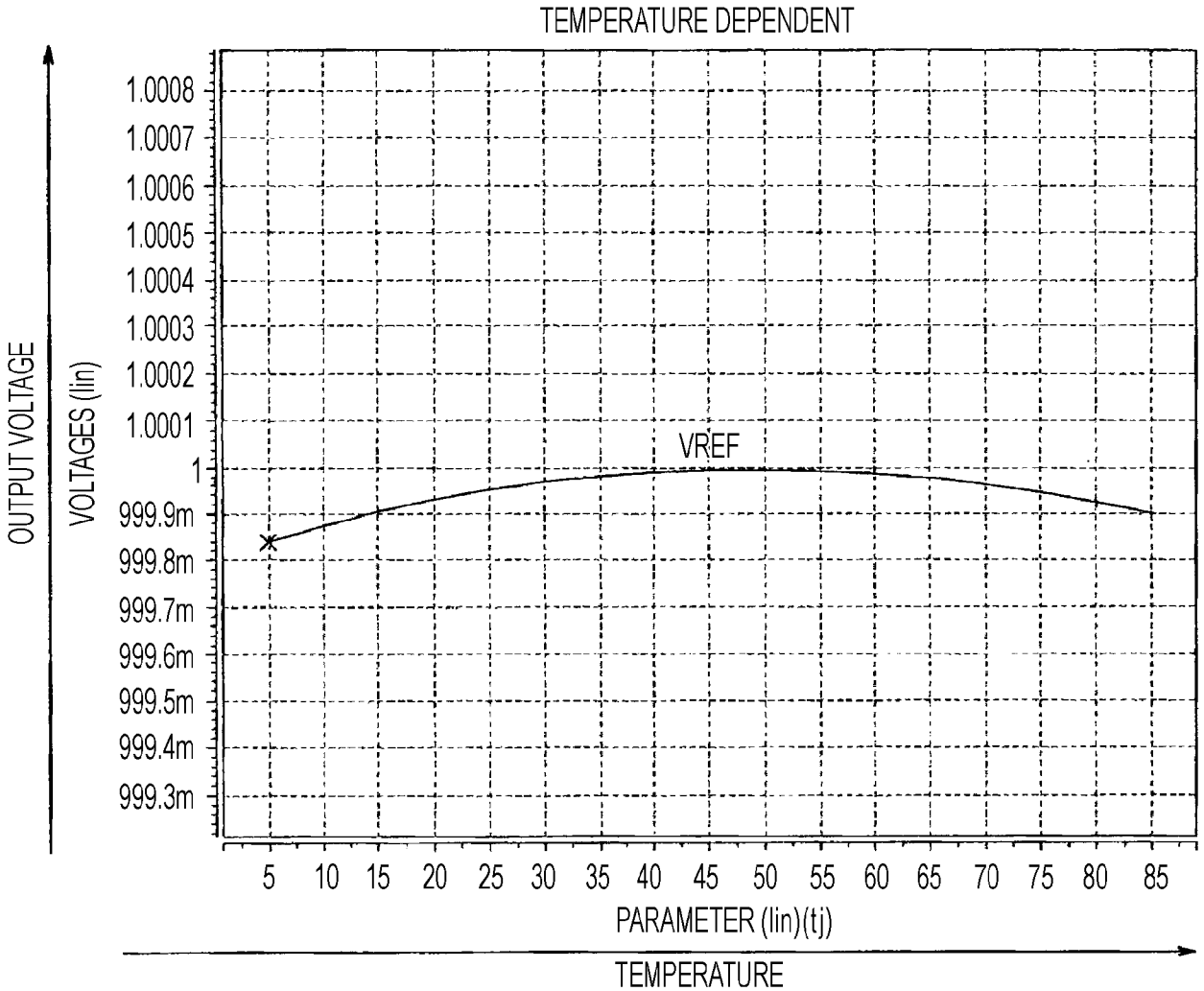
FIG. 5 illustrates the simulation result of the reference signal generating circuit.

FIG. 4 and FIG. 5 illustrate simulation results of the reference voltage generating circuit illustrated in FIG. 3.

FIG. 4 illustrates the relationship between a power source voltage VD supplied to the reference voltage generating circuit and an output voltage VREF output from the reference voltage generating circuit. In FIG. 4, the abscissa axis represents a value (volt: V) of power source voltage, and the ordinate axis represents a value (volt: V) of output voltage. Note that, in the abscissa axis and the ordinate axis, the unit is mV in a range below 1 V. This also applies to FIG. 5.

As is understood from FIG. 4, even when the power source voltage VD supplied to the reference voltage generating circuit varies from 1.4 V to 2.2 V, the output voltage VREF remains at about 1 V. Thus, it is found that the reference voltage generating circuit illustrated in FIG. 3 has no power source voltage dependency.

Note that FIG. 4 also illustrates the bias voltages NBIAS and NBIASC and the bias voltages PBIAS and PBIASC illustrated in FIG. 3. As illustrated in FIG. 4, the bias voltages PBIAS and PBIASC vary in proportion to the power source voltage VD with a constant voltage difference therebetween. On the other hand, the bias voltages NBIAS and NBIASC are stable when the power source voltage VD exceeds 1.4 V. It is found that the output voltage VREF becomes stable by the above described bias voltages.

FIG. 5 illustrates the relationship between a temperature of the operating environment of the reference voltage generating circuit and an output voltage VREF output from the reference voltage generating circuit. In FIG. 5, the abscissa axis represents a temperature (° C.), and the ordinate axis represents a value (volt: V) of output voltage.

As is understood from FIG. 5, even when the temperature of the operating environment of the reference voltage generating circuit varies from 5° C. to 85° C., the output voltage VREF changes slightly from 999.8 mV to 1 V. In other words, even when the temperature varies within the range of 80° C., the output voltage VREF varies just 0.2 mV. Thus, it is found that the reference voltage generating circuit illustrated in FIG. 3 has no temperature dependency.

(Second Embodiment)

Figure 6:
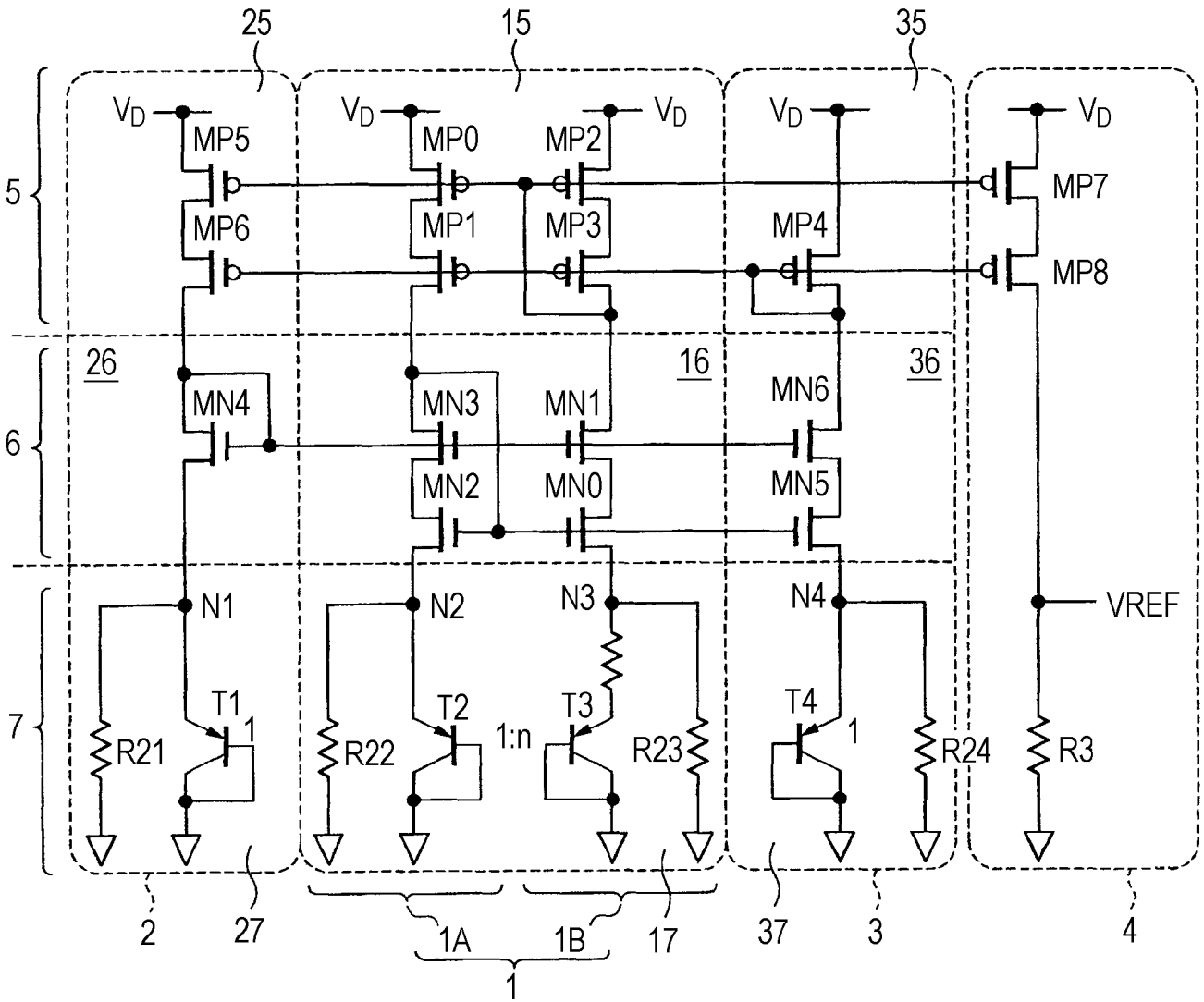
FIG. 6 illustrates another example of the configuration of a reference signal generating circuit.

FIG. 6 illustrates a configuration of a reference signal generating circuit according to a second embodiment. The reference signal generating circuit illustrated in FIG. 6 is an example of a reference voltage generating circuit in which pnp transistors T1 to T4 are provided instead of the pn junction diodes D1 to D4 in the reference voltage generating circuit illustrated in FIG. 1.

In the manufacturing process of a semiconductor device, diodes D1 to D4 appropriate for the reference signal generating circuit may not be formed on a semiconductor substrate made of silicon. In this case, as illustrated in FIG. 6, the pnp transistors T1 to T4 are used instead of the pn junction diodes D1 to D4 illustrated in FIG. 1. Therefore, the pnp transistors T1 to T4 each are short-circuited between a base electrode and a collector electrode. The ratio of the emitter-base junction area of each of the pnp transistors T1, T2 and T4 to the emitter-base junction area of the pnp transistor T4 is 1 to n. By so doing, the pnp transistors T1 to T4 illustrated in FIG. 6 operate similarly to the diodes D1 to D4 illustrated in FIG. 1. As a result, in the reference signal generating circuit illustrated in FIG. 6, the reference voltage VREF is obtained from the output unit 4 as an output voltage.

Note that in the manufacturing process of a semiconductor device, a pnp transistor may not be formed on a semiconductor substrate made of silicon. In this case, four npn transistors are used instead of the pn junction diodes D1 to D4. Therefore, the npn transistors each are short-circuited between the base electrode and the collector electrode. The ratio of the emitter-base junction area of the npn transistors corresponding to the pnp transistors T1, T2, and T4 to the emitter-base junction area of the npn transistor corresponding to the pnp transistor T4 is 1 to n.

(Third Embodiment)

Figure 7:
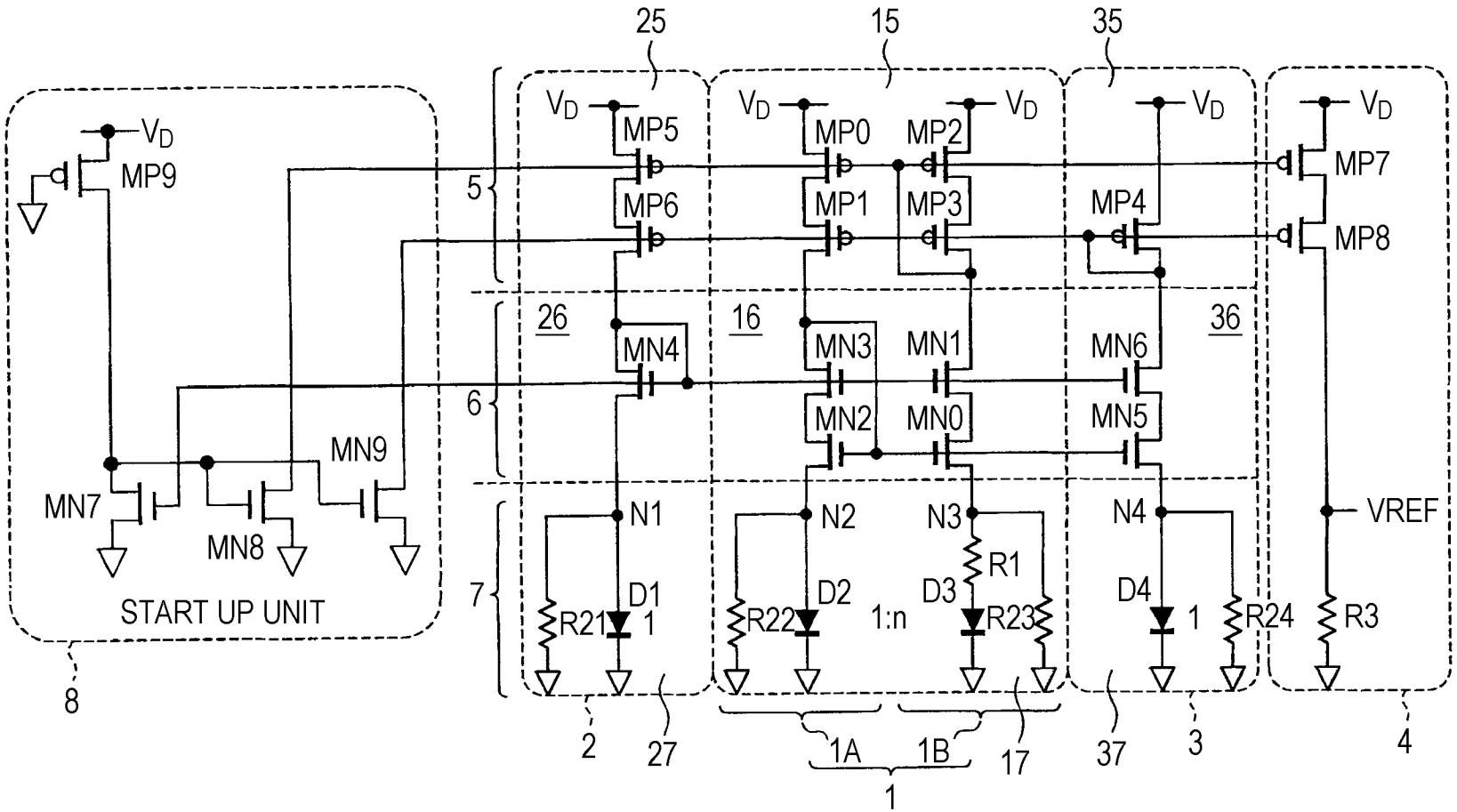
FIG. 7 illustrates another example of the configuration of a reference signal generating circuit.

FIG. 7 illustrates a configuration of a reference signal generating circuit according to a third embodiment. The reference signal generating circuit illustrated in FIG. 7 is an example of a reference voltage generating circuit that further includes a start up unit 8 in the reference voltage generating circuit illustrated in FIG. 1.

The reference voltage generating circuit has two points (operating points) at which the operation of the circuit is stable. The first operating point is an operating point at which no current flows and the circuit does not operate. The second operating point is an operating point at which a current flows properly and the circuit operates normally. When it is difficult for a current to flow through the circuit at the time of start up of the reference voltage generating circuit, there is a possibility that the operating point is stable at the first operating point and the circuit does not operate.

The start up unit 8 forcibly applies a current through the reference voltage generating circuit at the time of start up of the reference voltage generating circuit in order to prevent the reference voltage generating circuit from operating at the first operating point. Therefore, the start up unit 8 includes MP9 and MN7 to MN9.

The gate electrode of MP9 is connected to the ground potential. By doing so, a constant current flows through MP9 from the power source potential VD. MP9 and MN7 are connected in series between the power source potential VD and the ground potential. The gate electrode of MN7 is connected to the gate electrode of MN4. The gate electrodes of MN8 and MN9 are connected to a connecting point of MP9 and MN7. The drain electrodes of MN8 and MN9 are respectively connected to the gate electrodes of MP0 and MP1. In other words, the drain electrodes of MN8 and MN9 are connected to the gate electrodes of the cascode-connected MOSFETs in the first cascode current mirror circuit 5 to drive the gate electrodes.

As the power of the reference voltage generating circuit is turned on, a current flows through MP9 and then MN8 and MN9 turn on. By so doing, MP5 and MP6 turn on because the gate electrodes thereof are connected to the ground potential. Similarly, MP0 and MP1 and MP2 and MP3 also turn on similarly.

As MP5 and MP6 turn on, MN4 turns on because the gate electrode thereof is connected to the power source potential VD. By so doing, MN3, MN1, and MN6 turn on, and, in addition, MN2, MN0, and MN5 turn on.

As MN5 and MN6 turn on, MP4 turns on because the gate electrode thereof is connected to the ground potential. Thus, a current forcibly flows through the first cascode current mirror circuit 5 and the second cascode current mirror circuit 6. In addition, the first bias voltage generating unit 2 and the second bias voltage generating unit 3 generate bias voltages and output the bias voltages. The output unit 4 generates the reference voltage VREF as an output and then outputs the reference voltage VREF. By so doing, at the time of start up of the reference voltage generating circuit, the reference voltage generating circuit separates from the first operating point and is stable at the second operating point to operate normally.

On the other hand, as MN4 turns on, MN7 turns on because of the gate electrode thereof is connected to the power source potential VD. By so doing, MN8 and MN9 turn off because the gate electrodes thereof are connected to the ground potential. As a result, the start up unit 8 is not able to drive the first cascode current mirror circuit 5, and, as a result, is disconnected from the reference voltage generating circuit. In other words, the second cascode current mirror circuit 6 interrupts the start up unit 8 from the reference voltage generating circuit.

(Fourth Embodiment)

Figure 8:
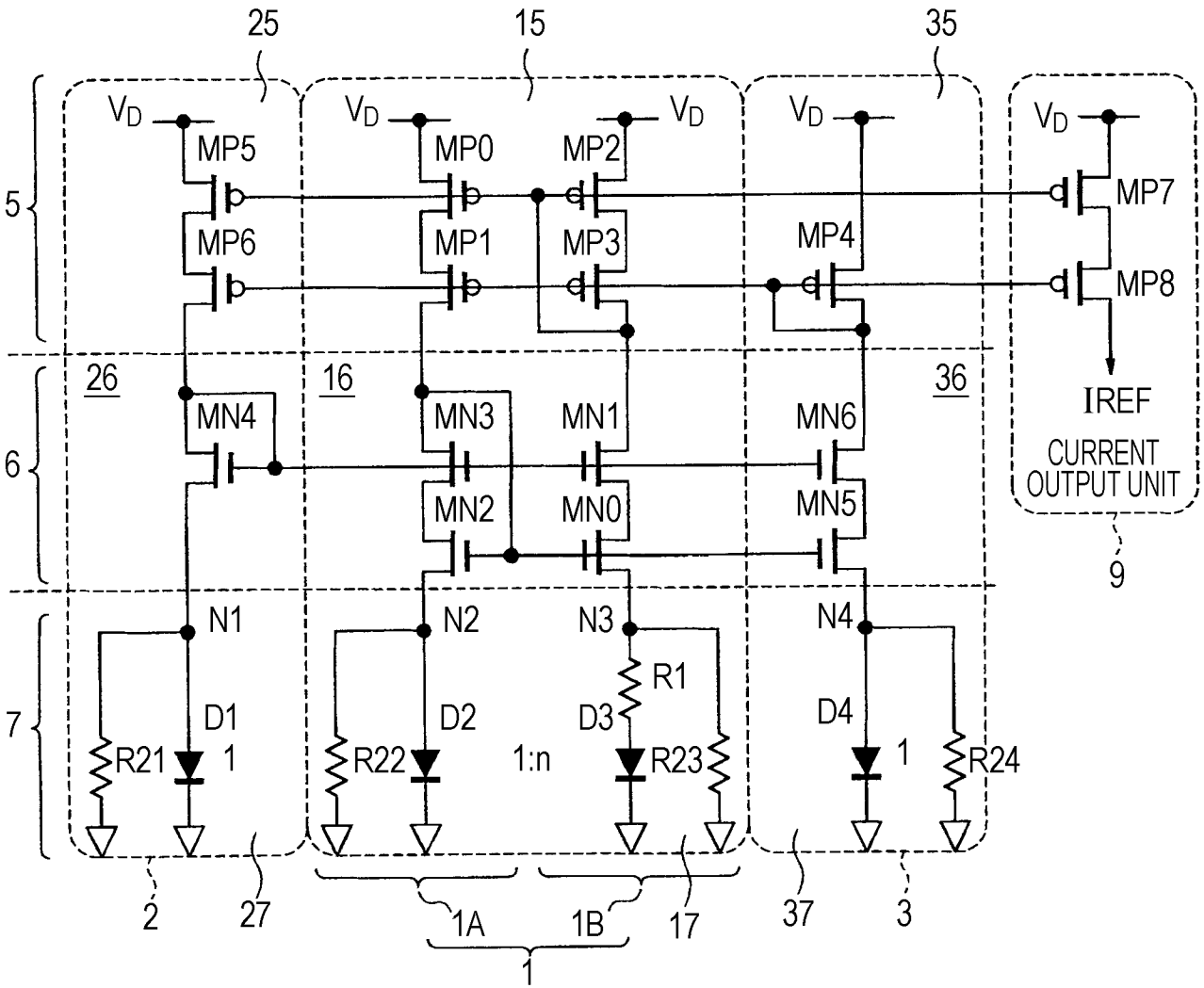
FIG. 8 illustrates another example of the configuration of a reference signal generating circuit.

FIG. 8 illustrates a configuration of a reference signal generating circuit according to a fourth embodiment. The reference signal generating circuit illustrated in FIG. 8 is an example of a reference current generating circuit.

The reference current generating circuit illustrated in FIG. 8 includes a current output unit 9 instead of the output unit 4 that outputs the reference voltage VREF in the reference voltage generating circuit illustrated in FIG. 1. The current output unit 9 includes MP7 and MP8. In other words, the current output unit 9 is a circuit that omits the resistance R3 in the output unit 4 of the reference voltage generating circuit illustrated in FIG. 1. The current output unit 9 outputs a reference current IREF from the drain electrode of MP8 as a reference signal. By so doing, it is possible to obtain the reference current IREF as a reference signal.

(Fifth Embodiment)

Figure 9:
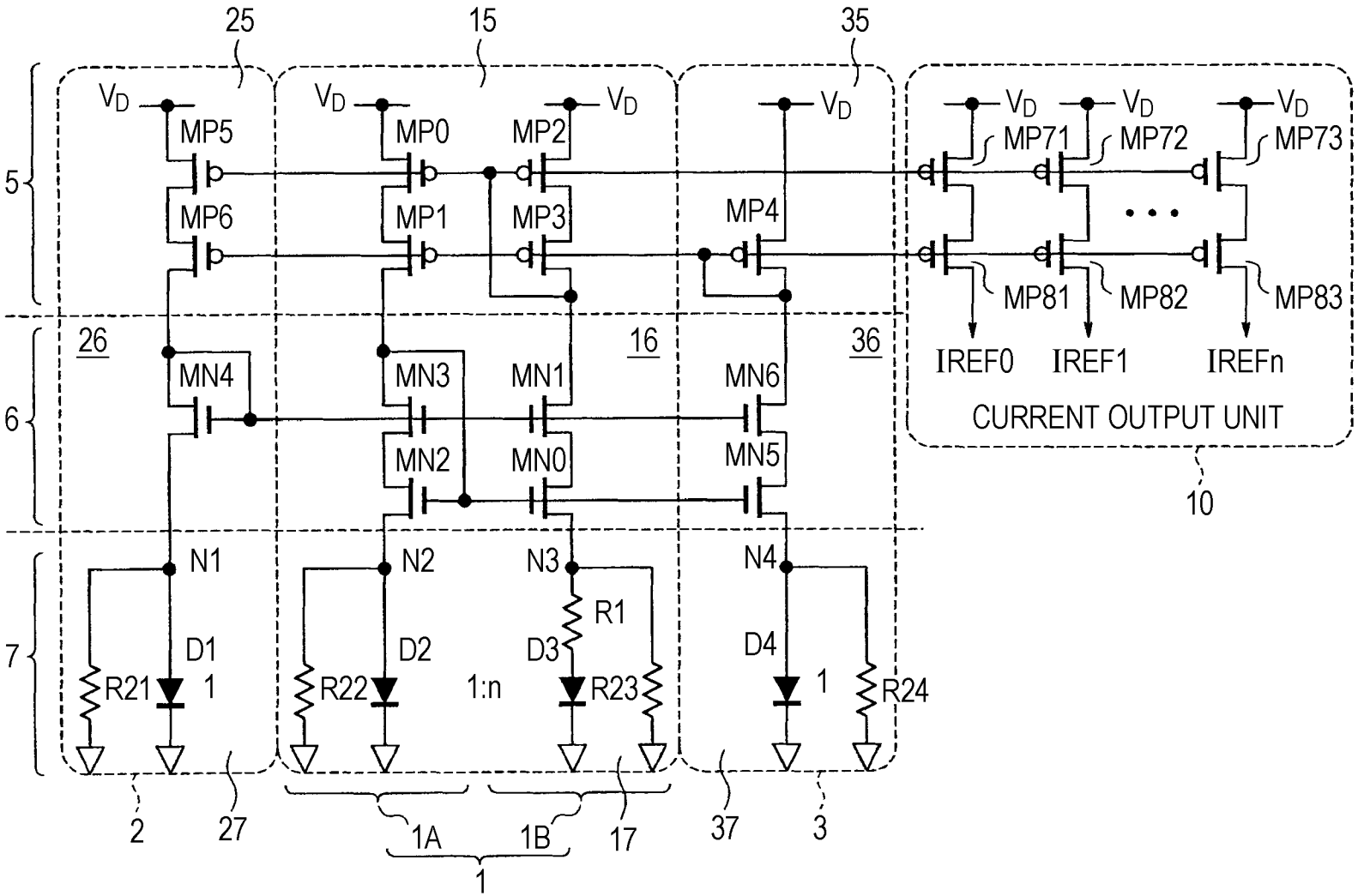
FIG. 9 illustrates another example of the configuration of a reference signal generating circuit.

FIG. 9 illustrates a configuration of a reference signal generating circuit according to a fifth embodiment. The reference signal generating circuit illustrated in FIG. 9 is an example of a reference current generating circuit that is able to extract a plurality of reference currents.

There is a case that it is necessary to supply reference currents respectively to a plurality of different circuits. However, the reference current generating circuit illustrated in FIG. 8 is merely able to output one reference current IREF. The reference current generating circuit illustrated in FIG. 9 includes a current output unit 10 instead of the current output unit 9.

The current output unit 10 includes a plurality of current mirror output circuits that are connected in parallel with one another, and outputs a plurality of reference currents IREF0 to IREFn. The current mirror output circuit of the current output unit 10, for example, includes MP71 and MP81 that are connected in series with each other, and outputs the reference current IREF0 as a reference signal. This also applies to the other current mirror output circuits of the current output unit 10.

Values of the plurality of reference currents IREF0 to IREFn may be different or may be equal. The values of the reference currents IREF0 to IREFn are substantially equal to the value of the current that flows through the main unit 1 or are determined based on MOSFETs in the current mirror circuits of the current output unit 10. In other words, the values of the reference currents IREF0 to IREFn are determined depending on the ratio of the size of MP0 to MP3 that make up the first cascode current mirror unit 15 of the main unit 1 to the size of, for example, MP71 and MP81. For example, when the ratio of the size of MP0 to MP3 to the size of MP71 and MP81 is 1 to x, an output current that is x times as large as the current that flows through the main unit 1 is obtained. The x is not necessarily an integer.

(Sixth Embodiment)

Figure 10:
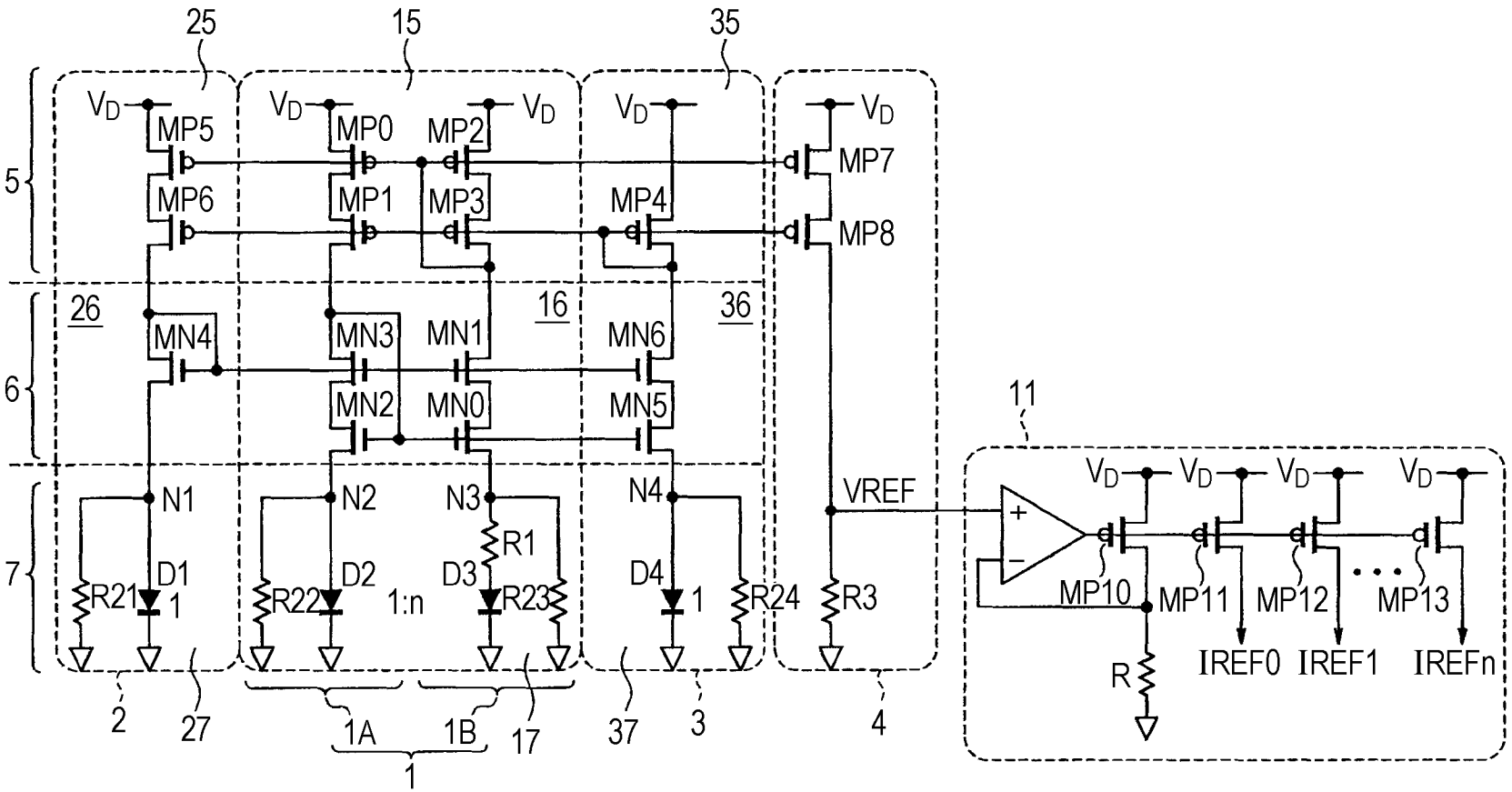
FIG. 10 illustrates another example of the configuration of a reference signal generating circuit.

FIG. 10 illustrates a configuration of a reference signal generating circuit according to a sixth embodiment. The reference signal generating circuit illustrated in FIG. 10 is an example of a reference current generating circuit that includes a voltage-to-current conversion circuit.

In the reference current generating circuits illustrated in FIG. 8 and FIG. 9, the values of the plurality of reference currents IREF0 to IREFn depend on the ratio of the size of MP0 to MP3 that make up the first cascode current mirror circuit to the size of MOSFETs of the current mirror output circuits of the current output unit 9 or 10, as described above. Thus, in the reference current generating circuits illustrated in FIG. 8 and FIG. 9, the values of the plurality of reference currents IREF0 to IREFn may not be freely selected. Then, the reference current generating circuit illustrated in FIG. 10 includes a voltage-to-current conversion circuit 11 instead of the current output unit 9 or 10.

The voltage-to-current conversion circuit 11 includes a buffer circuit and a plurality of current mirror output circuits connected in parallel with one another, and outputs a plurality of reference currents IREF0 to IREFn. The buffer circuit includes an amplifier AMP, an output MP10, and a resistance R. The buffer circuit converts an input reference voltage VREF into an output voltage determined in accordance with the buffer circuit, and outputs the output voltage to the gate electrode of MP10 and the gate electrodes of MP11 to MP13 for outputting.

Owing to the buffer circuit, in FIG. 10, the reference current generating circuit is separated from the MP10 to MP13 for outputting, and, as a result, is separated from the voltage-to-current conversion circuit 11. Thus, in the voltage-to-current conversion circuit 11, the values of the plurality of reference currents IREF0 to IREFn may be freely set. In other words, in the voltage-to-current conversion circuit 11, the values of the plurality of reference currents IREF0 to IREFn may be determined independent of the ratio of the size of MP0 to MP3 that make up the first cascode current mirror circuit to the size of MOSFETs of the current mirror circuits of the current output unit 10.

In the voltage-to-current conversion circuit 11, the values of the plurality of reference currents IREF0 to IREFn are determined by the value of the resistance R. In other words, the value of the resistance R is obtained from R=VREF/IREF0. In this case, the values of the plurality of reference currents IREF0 to IREFn are substantially equal.

Note that the reference current generating circuit is separated from the voltage-to-current conversion circuit 11, so the power source voltage of the voltage-to-current conversion circuit 11 may be different from the power source voltage VD of the reference current generating circuit. For example, the power source voltage VD of the reference current generating circuit may be 1.8 V, and the power source voltage of the voltage-to-current conversion circuit 11 may be 1.0 V.

(Seventh Embodiment)

Figure 11:
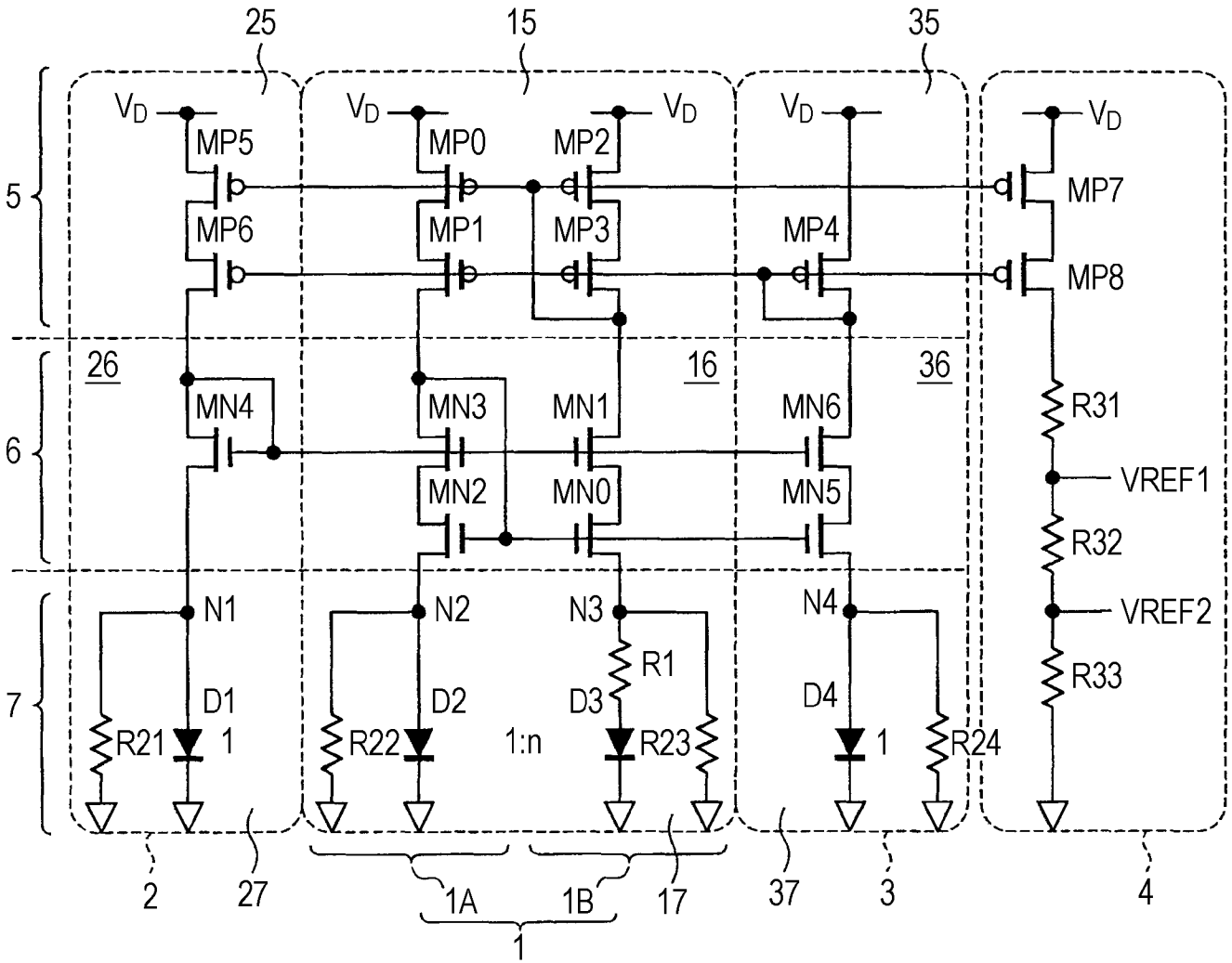
FIG. 11 illustrates another example of the configuration of a reference signal generating circuit.

FIG. 11 illustrates a configuration of a reference signal generating circuit according to a seventh embodiment of the invention. The reference signal generating circuit illustrated in FIG. 11 is an example of a reference voltage generating circuit that is able to extract a plurality of reference voltages VREF1 to VREF2.

It may be necessary to supply reference voltages respectively to a plurality of different circuits. However, the reference voltage generating circuit illustrated in FIG. 1 is just able to output one reference voltage VREF. Then, the reference voltage generating circuit illustrated in FIG. 11 includes, for example, three divided resistances R31 to R33 instead of the resistance R3 in the output unit 4. The sum of the resistance values of the divided resistances R31 to R33 corresponds to the resistance value of the resistance R3 in the reference voltage generating circuit illustrated in FIG. 1.

In the output unit 4, an output current from MP8 is divided by the three divided resistances R31 to R33, and two reference voltages VREF1 and VREF2 are generated. The number of the divided resistances is not limited to three, so the number of the obtained reference voltages VREF1 and VREF2 is also not limited to two.

(Eighth Embodiment)

Figure 12:
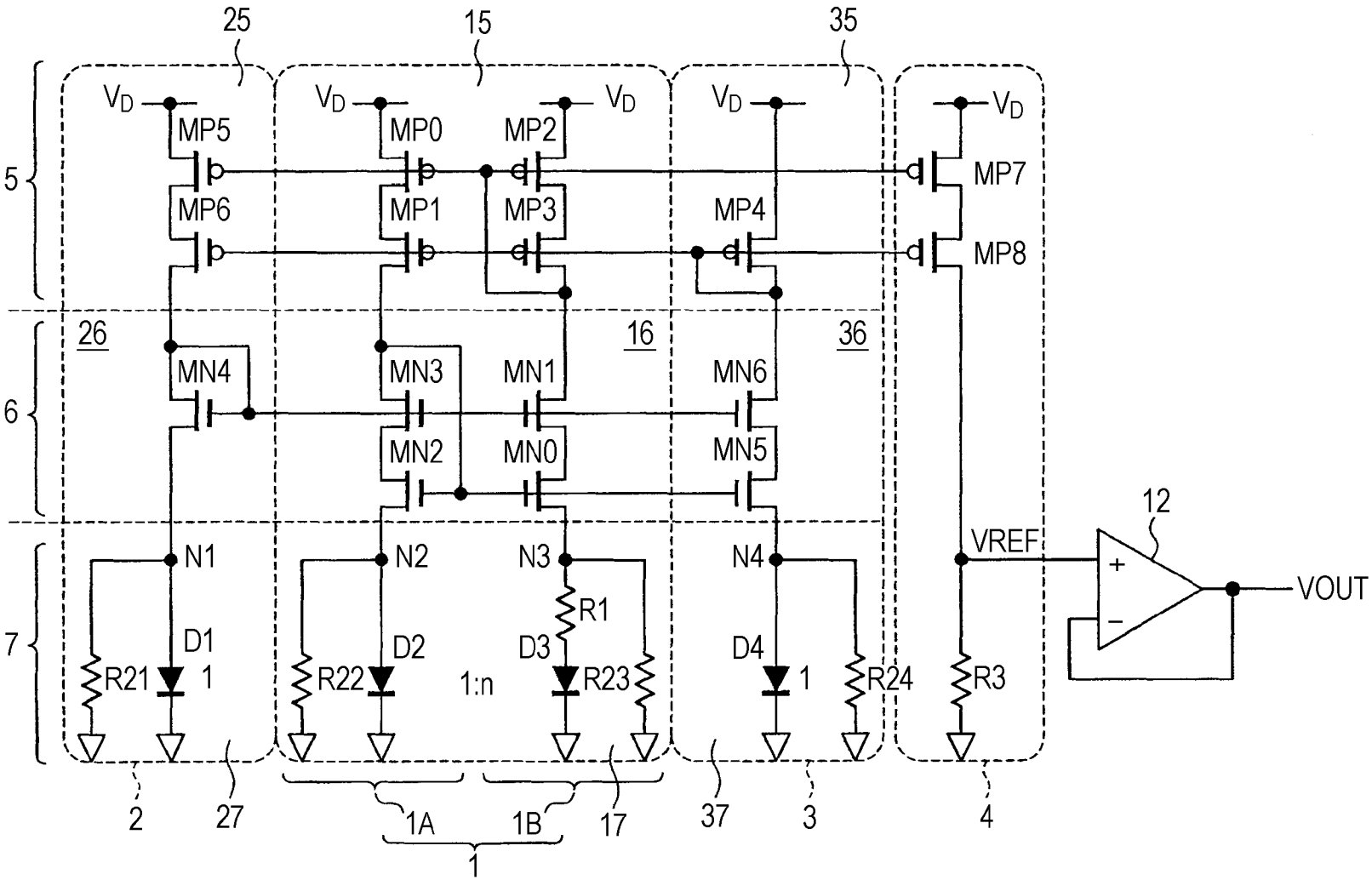
FIG. 12 illustrates another example of the configuration of a reference signal generating circuit.

FIG. 12 illustrates a configuration of a reference signal generating circuit according to an eighth embodiment. The reference signal generating circuit illustrated in FIG. 12 is an example of a reference voltage generating circuit that includes a buffer circuit for driving a large load.

In the reference voltage generating circuit illustrated in FIG. 1, the output unit 4 may not be able to drive a large load if, for example, a plurality of circuits are connected. Then, the reference current generating circuit illustrated in FIG. 11 further includes a buffer circuit 12 in addition to the output unit 4.

The buffer circuit 12 may be, for example, an amplifier AMP having a gain of 1. The buffer circuit 12 converts an input reference voltage VREF into an output voltage VOUT having a substantially equal value and outputs the output voltage VOUT. Owing to the buffer circuit 12, in FIG. 12, the reference voltage generating circuit is able to drive a large-load circuit even when the large-load circuit is connected downstream of the buffer circuit 12. In other words, the output voltage VOUT is able to drive a load larger than the reference voltage VREF.

Note that, as in the case of the reference voltage generating circuit illustrated in FIG. 10, owing to the buffer circuit 12, the reference current generating circuit is separated from a circuit connected downstream of the buffer circuit 12. Thus, it is possible to set the gain of the amplifier AMP at a value other than 1. Thus, it is possible to freely set the value of the output voltage VOUT.

What is claimed is:

1. A reference signal generating circuit comprising:

a band gap reference main unit that includes a first cascode current mirror unit having a plurality of first conductive-type transistors, a second cascode current mirror unit having a plurality of second conductive-type transistors, and a reference unit that uses a band gap to generate a reference signal, wherein the first cascode current mirror unit is connected to a first potential, the reference unit is connected to a second potential, and the second cascode current mirror unit is connected between the first cascode current mirror unit and the reference unit;

a first bias voltage generating unit that copies a current flowing through the first cascode current mirror unit to generate a bias voltage of the second cascode current mirror unit and comprises a first serial circuit comprising a first resistor and a first diode;

a second bias voltage generating unit that copies a current flowing through the second cascode current mirror unit to generate a bias voltage of the first cascode current mirror unit; and an output unit that generates the reference signal based upon an output of the band gap reference main unit, and outputs the reference signal, the reference unit includes a first diode that is connected to one of a plurality of current mirrors that make up the second cascode current mirror unit, and a second diode that is connected to another one of the plurality of current mirrors that make up the second cascode current mirror unit and that has a pn junction area that is n times as large as a pn junction area of the first diode, the first bias voltage generating unit further includes a diode having the same pn junction area as that of the first diode, and the second bias voltage generating unit further includes a diode having the same on junction area as that of the first diode.

2. The reference signal generating circuit according to claim 1, wherein the first conductive-type transistor is a p-channel MOSFET, the second conductive-type transistor is an n-channel MOSFET, the first potential is a power source potential, and the second potential is a ground potential.

3. The reference signal generating circuit according to claim 1, wherein the first bias voltage generating unit includes a plurality of first conductive-type transistors that are cascode-connected in the same manner as a cascode-connection of the first cascode current mirror unit; and the second bias voltage generating unit includes a plurality of second conductive-type transistors that are cascode-connected in the same manner as a cascode-connection of the second cascode current mirror unit.

4. The reference signal generating circuit according to claim 1, wherein the reference unit further includes a first auxiliary resistance connected in parallel with the first diode and a second auxiliary resistance connected in parallel with the second diode, the first bias voltage generating unit further includes an auxiliary resistance that is connected in parallel with the diodes having the same pn junction area as that of the first diode, and the second bias voltage generating unit further includes an auxiliary resistance that is connected in parallel with the diodes having the same pn junction area as that of the first diode.

5. The reference signal generating circuit according to claim 1, wherein the second bias voltage generating unit comprises a second serial circuit comprising a second resistor and a second diode.

6. A reference signal generating circuit comprising:

a band gap reference main unit that includes a first cascode current mirror unit having a plurality of first conductive-type transistors, a second cascode current mirror unit having a plurality of second conductive-type transistors, and a reference unit that uses a band gap to generate a reference signal, wherein the first cascode current mirror unit is connected to a first potential, the reference unit is connected to a second potential, and the second cascode current mirror unit is connected between the first cascode current mirror unit and the reference unit;

a first bias voltage generating unit that copies a current flowing through the first cascode current mirror unit to generate a bias voltage of the second cascode current mirror unit;

a second bias voltage generating unit that copies a current flowing through the second cascode current mirror unit to generate a bias voltage of the first cascode current mirror unit; and an output unit that generates a reference signal based upon an output of the band gap reference main unit, and outputs the reference signal, the first bias voltage generating unit includes a plurality of first conductive-type transistors that are cascode-connected in the same manner as a cascode-connection of the first cascode current mirror unit and a diode having the same pn junction area as that of a first diode, the second bias voltage generating unit includes a plurality of second conductive-type transistors that are cascode-connected in the same manner as a cascode-connection of the second cascode current mirror unit and a diode having the same pn junction area as that of the first diode, and the reference unit includes the first diode that is connected to one of a plurality of current mirrors that make up the second cascode current mirror unit, and a second diode that is connected to another one of the plurality of current mirrors that make up the second cascode current mirror unit and that has a pn junction area that is n times as large as a pn junction area of the first diode.

7. The reference signal generating circuit according to claim 6, wherein the reference unit further includes a first auxiliary resistance connected in parallel with the first diode and a second auxiliary resistance connected in parallel with the second diode, the first bias voltage generating unit further includes an auxiliary resistance that is connected in parallel with the diodes having the same pn junction area as that of the first diode, and the second bias voltage generating unit further includes an auxiliary resistance that is connected in parallel with the diodes having the same pn junction area as that of the first diode.

* * * * *